US006088563A

United States Patent [19]

Shimizu

[11] Patent Number: 6,088,563

[45] Date of Patent: Jul. 11, 2000

[54] DEVELOPING DEVICE AND DEVELOPING METHOD WITH A SPECIFIED IMPEDANCE

[75] Inventor: Tamotsu Shimizu, Settsu, Japan

[73] Assignee: Minolta Co., Ltd., Osaka, Japan

[21] Appl. No.: 09/347,277

[22] Filed: Jul. 6, 1999

[30] Foreign Application Priority Data

Jul. 31, 1998 [JP] Japan ..... 10-217987

[51] Int. Cl.[7] ..... G03G 15/08

[52] U.S. Cl. ..... 399/270; 399/276; 430/122

[58] Field of Search ..... 399/55, 270, 276, 399/285, 286; 430/108, 122, 120

[56] References Cited

U.S. PATENT DOCUMENTS

| | | | |
|---|---|---|---|
| 4,430,410 | 2/1984 | Aizawa et al. | 430/122 |
| 4,746,589 | 5/1988 | Haneda et al. | 430/120 |
| 5,688,622 | 11/1997 | Ito et al. | 430/102 |
| 5,736,287 | 4/1998 | Kobayashi et al. | 430/102 |
| 5,849,452 | 12/1998 | Takenaka et al. | 430/122 |

OTHER PUBLICATIONS

Abstract of JP 10–148972A, Jun. 2, 1998.

*Primary Examiner*—Joan Pendegrass

*Attorney, Agent, or Firm*—Burns, Doane, Swecker & Mathis, LLP

[57] ABSTRACT

In a developing device and a developing method in which a developer containing toners and carriers is conveyed to a developing area opposite to an image carrying member with it being held on the surface of a developer carrying member, and the toners in the developer are supplied to the electrostatic latent image formed on the image carrying member upon exerting an electric field between the developer carrying member and the image carrying member, to perform development, an impedance Zs ($\Omega/cm^2$) per unit area of the surface of said developer carrying member and an impedance Zc ($\Omega/cm^2$) of said carriers satisfy the condition of $1.8\times10^5 \leqq Zs\cdot Zc \leqq 2.1\times10^9$.

19 Claims, 3 Drawing Sheets

DEVELOPING DEVICE AND DEVELOPING METHOD WITH A SPECIFIED IMPEDANCE

This application is based on application No. 217987/1998 Jul. 31, 1998 filed in Japan, the contents of which is hereby incorporated by reference.

BACKGROUND OF THE INVENTION

1. Field of the Invention

The present invention relates generally to a method of developing an electrostatic latent image formed on an image carrying member and a developing device used for the development in an image forming apparatus such as a copying machine or a printer, and more particularly, to a developing device and a developing method in which a developer containing toners and carriers is conveyed to a developing area opposite to an image carrying member with it being held on the surface of a developer carrying member, and the toners in the developer are supplied to an electrostatic latent image formed on the image carrying member upon exerting an electric field between the developer carrying member and the image carrying member.

2. Description of the Related Art

In an image forming apparatus such as a copying machine or a printer, various developing devices have been conventionally used for developing an electrostatic latent image formed on an image carrying member.

As such a developing device, a developing device using a two-component developer containing toners and carriers has been used in addition to a developing device using a monocomponent developer containing only toners.

As the developing device using a two-component developer containing toners and carriers, a developing device as shown in FIG. 1 has been known.

In the developing device shown in FIG. 1, a magnet member 12 having a plurality of magnetic poles N, S, . . . is provided on the inner periphery side of a developer carrying member 11 in a cylindrical shape which is provided opposite to an image carrying member 1. A developer 2 contained in the main body 10 of the developing device is mixed and agitated by a developer agitating member 13, and is supplied to the developer carrying member 11 by the developer agitating member 13, to hold the developer 2 on the surface of the developer carrying member 11 by a magnetic force produced by the magnet member 12.

The developer carrying member 11 is rotated, to convey the developer 2 in the state of a magnetic brush, and the amount of the developer 2 conveyed by the developer carrying member 11 is adjusted by a regulating member 14, to convey the developer 2 in a suitable amount to a developing area opposite to the image carrying member 1 by the developer carrying member 11. A DC bias voltage is applied to the developer carrying member 11 from a DC power supply 15, and an AC bias voltage is applied from an AC power supply 16. An electric field which is an overlapping of an AC electric field and a DC electric field is exerted in a developing area where the developer carrying member 11 and the image carrying member 1 are opposite to each other, and the toners in the developer 2 are supplied to the image carrying member 1, thereby developing the electrostatic latent image formed on the image carrying member 1.

When the electric field which is an overlapping of the AC electric field and the DC electric field is thus exerted in the developing area where the developer carrying member 11 and the image carrying member 1 are opposite to each other to perform development, a high AC electric field must be exerted in the developing area in order to efficiently separate the toners in the developer 2 from the carriers. Particularly when toners having a small diameter are used, adhesion between the toners and the carriers is high. Accordingly, a higher AC electric field must be exerted.

When the AC electric field exerted between the developer carrying member 11 and the image carrying member 1 is thus strengthened, a leak occurs between a magnetic brush formed of the developer 2 on the surface of the developer carrying member 11 and the image carrying member 1. Further, the carriers in the developer 2 adhere to the image carrying member 1, so that noises are produced in a formed image.

In order to prevent the occurrence of a leak and the adhesion of carriers, it is considered that carriers having a high resistance are used for the developer 2. When the carriers having a high resistance are used, however, an electric field exerted between the developer carrying member 11 and the image carrying member 1 is weakened. Therefore, the toners in the developer 2 are not satisfactorily separated from the carriers. Accordingly, the toners are not sufficiently supplied to the electrostatic latent image formed on the image carrying member 1, so that the density of the formed image is decreased.

SUMMARY

An object of the present invention is to solve the above-mentioned problems in a case where a developer containing toners and carriers is conveyed to a developing area opposite to an image carrying member with it being held on the surface of a developer carrying member, and the toners in the developer are supplied to an electrostatic latent image formed on the image carrying member upon exerting an electric field between the developer carrying member and the image carrying member, to perform development.

A first object of the present invention is to prevent a leak from occurring between a magnetic brush formed of a developer and an image carrying member and prevent carriers in the developer from adhering to the image carrying member in supplying toners in the developer to an electrostatic latent image formed on the image carrying member upon exerting an electric field on a developing area where the developer carrying member and the image carrying member are opposite to each other, as described above, to prevent noises from being produced in a formed image.

Another object of the present invention is to make it possible to obtain a good image having a sufficient image density upon sufficiently supplying toners in a developer to an electrostatic latent image formed on an image carrying member.

A developing device according to the present invention is for developing an electrostatic latent image formed on an image carrying member by toners, and comprises a developer carrying member arranged opposite to the image carrying member for holding a developer containing toners and carriers, and a power supply member for exerting an electric field between the image carrying member and the developer carrying member. Letting Zs ($\Omega/cm^2$) be an impedance per unit area of the surface of the developer carrying member, and letting Zc ($\Omega/cm^2$) be an impedance of the carriers, a relationship of $1.8\times10^5 \leqq Zs\cdot Zc \leqq 2.1\times10^9$ is satisfied.

A developing method according to the present invention comprises the steps of supplying a developer containing toners and carriers onto a developer carrying member arranged opposite to an image carrying member, conveying the developer held on the developer carrying member to a developing area opposite to the image carrying member, and supplying the toners in the developer to an electrostatic latent image formed on the image carrying member and developing the electrostatic latent image under the exertion of an electric field. Letting Zs ($\Omega/cm^2$) be an impedance per unit area of the surface of the developer carrying member, and letting Zc ($\Omega/cm^2$) be an impedance of the carriers, a relationship of $1.8\times10^5 \leqq Zs\cdot Zc \leqq 2.1\times10^9$ is satisfied.

As in the developing device and the developing method in the present invention, when the impedance Zs per unit area on the surface of the developer carrying member and the impedance Zc of the carriers satisfy the above-mentioned relationship, a suitable electric field is exerted on a developing area where the developer carrying member and the image carrying member are opposite to each other by the power supply member. Therefore, it is possible to prevent a leak from occurring between the magnetic brush formed of the developer and the image carrying member and to prevent the carriers in the developer from adhering to the image carrying member. Accordingly, noises are prevented from being produced in a formed image. Further, the toners in the developer are satisfactorily separated from the carriers, and are sufficiently supplied to the electrostatic latent image formed on the image carrying member. Therefore, an image having a sufficient image density is obtained.

In causing the impedance Zs per unit area on the surface of the developer carrying member and the impedance Zc of the carriers to satisfy the above-mentioned condition, it is possible to use methods such as a method of providing a suitable coat layer on the surface of the developer carrying member, a method of changing the type and the thickness of resin with which the carriers are to be coated, and a method of changing the type or the like of resin used for binder-type carriers.

In supplying the toners in the developer to the electrostatic latent image formed on the image carrying member upon exerting an electric field between the developer carrying member and the image carrying member by the power supply member, as described above, if the amount of the developer to be conveyed to the developing area is too large, the carriers in the developer easily adhere to the image carrying member. On the other hand, if the amount of the developer in the developing area is too small, the toners in the developer are not sufficiently supplied to the electrostatic latent image formed on the image carrying member. Accordingly, an image having a sufficient image density is not obtained. Therefore, it is preferable that the filling factor of the developer in the developing area is in the range of 2 to 8%.

The filling factor P (%) of the developer in the developing area is found by the following equation (1) when the amount of the developer conveyed to the developing area by the developer carrying member is taken as w ($g/cm^2$), the true specific gravity of the developer is taken as ρ ($g/cm^3$), and a distance between the developer carrying member and the image carrying member in the developing area is taken as Ds (cm):

$$P(\%)=100\times w/(\rho\cdot Ds) \quad (1)$$

The true specific gravity ρ of the developer is found by the following equation (2) when the true specific gravity of the carriers is taken as ρ1 ($g/cm^3$), the true specific gravity of the toners is taken as ρ2 ($g/cm^3$), and the toner density in the developer is Tc (%);

$$\rho=[\rho_1\times(100-Tc)+\rho2\times Tc]/100 \quad (2)$$

There and other objects, advantages and features of the invention will become apparent from the following description thereof taken in conjunction with the accompanying drawings which illustrate specific embodiment of the invention.

DESCRIPTION OF THE PREFERRED EMBODIMENTS

A developing device and a developing method according to a preferred embodiment of the present invention will be specifically described on the basis of the accompanying drawings.

Figure 1:
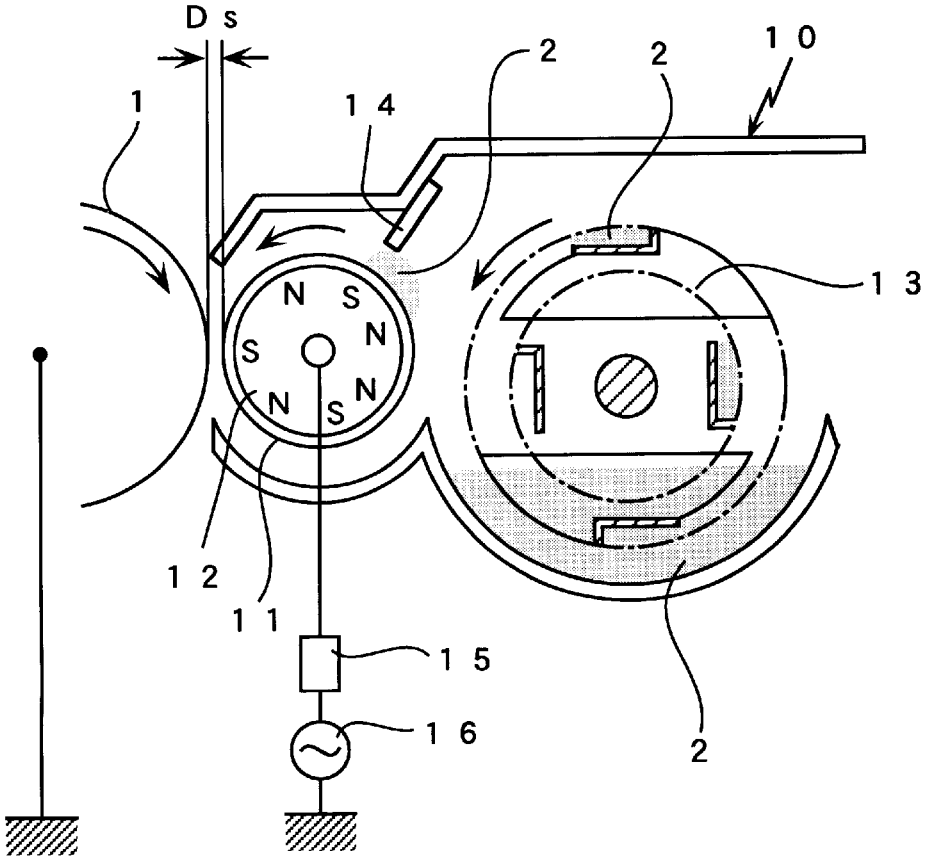
FIG. 1 is a schematic sectional view of a developing device using a developer including toners and carriers.

Also in the developing device and the developing method in the present embodiment, a developer 2 containing toners and carriers is used, and the developer 2 is mixed and agitated by a developer agitating member 13 provided in the main body 10 of the developing device, and the developer 2 is supplied to the surface of the developer carrying member 1 in a cylindrical shape which is provided opposite to an image carrying member 1, and is held on the surface of a developer carrying member 11 by a magnetic force produced by a magnet member 12 having a plurality of magnetic poles N, S, which is provided on the inner periphery side of the developer carrying member 11, as in the conventional developing device shown in FIG. 1.

The developer carrying member 11 is rotated, to convey the developer 2 in the state of a magnetic brush, and the amount of the developer 2 thus conveyed is adjusted by a regulating member 14. The developer 2 in a suitable amount is conveyed to a developing area opposite to the image carrying member 1 by the developer carrying member 11. A DC bias voltage is applied from a DC power supply 15 to the developer carrying member 11, and an AC bias voltage is applied from an AC power supply 16. The toners in the developer 2 are supplied to the image carrying member 1, to develop an electrostatic latent image formed on the image carrying member 1.

Figure 2:
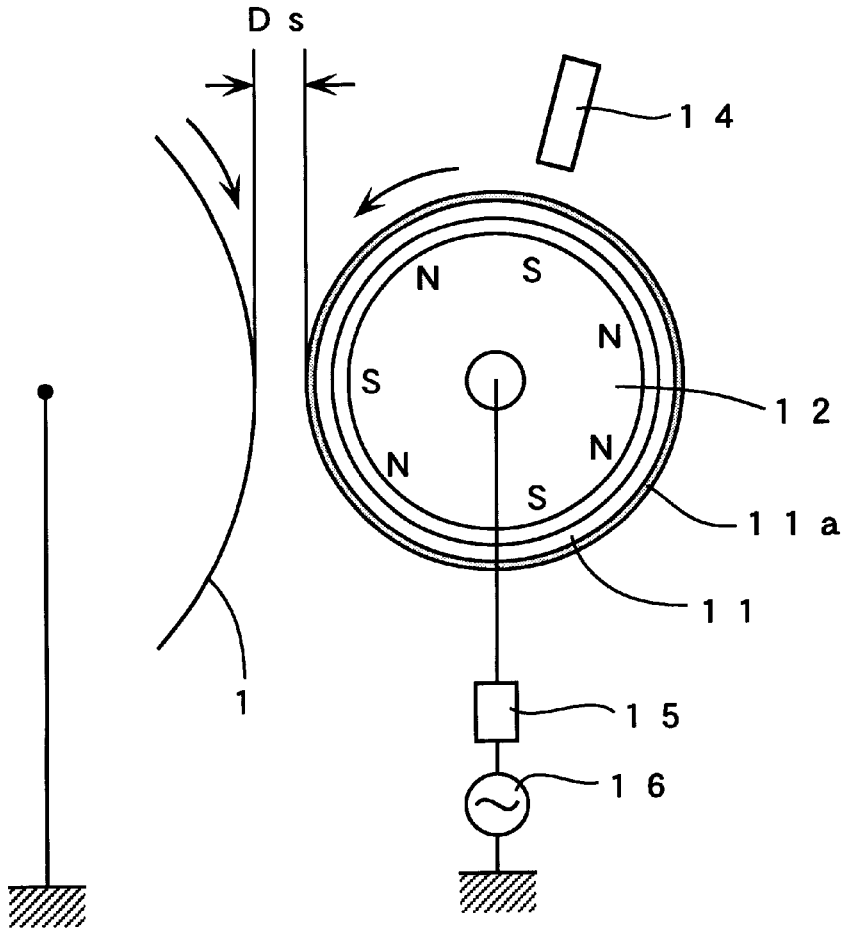
FIG. 2 is a partial explanatory view of a developing device according to one embodiment of the present invention.

In the present embodiment, a coat layer 11*a* made of resin is provided on the surface of the developer carrying member 11, and carriers having a suitable impedance Zc are used as the carriers in the developer 2, as shown in FIG. 2, so that the impedance Zs ($\Omega/cm^2$) per unit area of the surface of the developer carrying member 11 and the impedance Zc ($\Omega/cm^2$) of the carriers satisfy the condition of $1.8\times10^5 \leqq Zs\cdot Zc \leqq 2.1\times10^9$.

An experiment in which the type of the coat layer 11*a* provided on the surface of the developer carrying member 11 and the type of the carriers used for the developer 2 are changed is conducted. The embodiment which satisfies the condition of the invention and a comparative example which does not satisfy the condition of the invention are compared with each other, to clarify that a leak is prevented from occurring between a magnetic brush formed of the developer 2 formed on the surface of the developer carrying member 11 and the image carrying member 1, and the toners in the developer 2 are sufficiently supplied to the electrostatic latent image formed on the image carrying member 1, to obtain an image having a sufficient image density in the embodiment of the present invention.

In this experiment, used as the developer carrying member 11 was one having a coat layer 11*a* made of nylon provided on the surface of an aluminum pipe. The thickness of the coat layer 11*a* was changed, to adjust the impedance Zs per unit area of the surface of the developer carrying member 11, to produce four types of developer carrying members S1 to S4 respectively having impedances Zs per unit area of $3.34\times10^3$ Ω/cm$^2$, $6.94\times10^2$ Ω/cm$^2$, 17.4 Ω/cm$^2$, and 8.01×10−3 cm$^2$, as shown in the following Table 1 to Table 4. The impedance Zs (Ω/cm$^2$) per unit area of the surface of each of the developer carrying members S1 to S4 was found by using a resistance measuring device (KC-547 manufactured by Kokuyo Denki Kogyo K.K.), applying an AC voltage having a frequency of 3 kHz at a voltage of 1 V between both ends in the axial direction of the coat layer 11*a* formed on the surface of the developer carrying member, setting a circuit mode to an auto-mode, measuring the impedance between both the ends in the axial direction of the coat layer 11*a,* and dividing the impedance by the surface area of the coat layer 11*a.*

Coat carriers each having ferrite coated with silicone resin and binder-type carriers each having magnetite powder bound by polyester resin were used as the carriers used for the developer 2. Examples of the carriers were coat carriers C1 having an impedance Zc of $6.2\times10^5$ Ω/cm$^2$, coat carriers C2 having an impedance of $1.0\times10^7$ Ω/cm$^2$, coat carriers C3 having an impedance Zc of $6.3\times10^7$ Ω/cm$^2$, coat carriers C4 having an impedance Zc of $9.4\times10^7$ Ω/cm$^2$, binder-type carriers C5 having an impedance Zc of $1.5\times10^8$ Ω/cm$^2$, and coat carriers C6 having an impedance Zc of $2.4\times10^8$ Ω/cm$^2$, as shown in the following Table 1 to Table 4.

Figure 3:
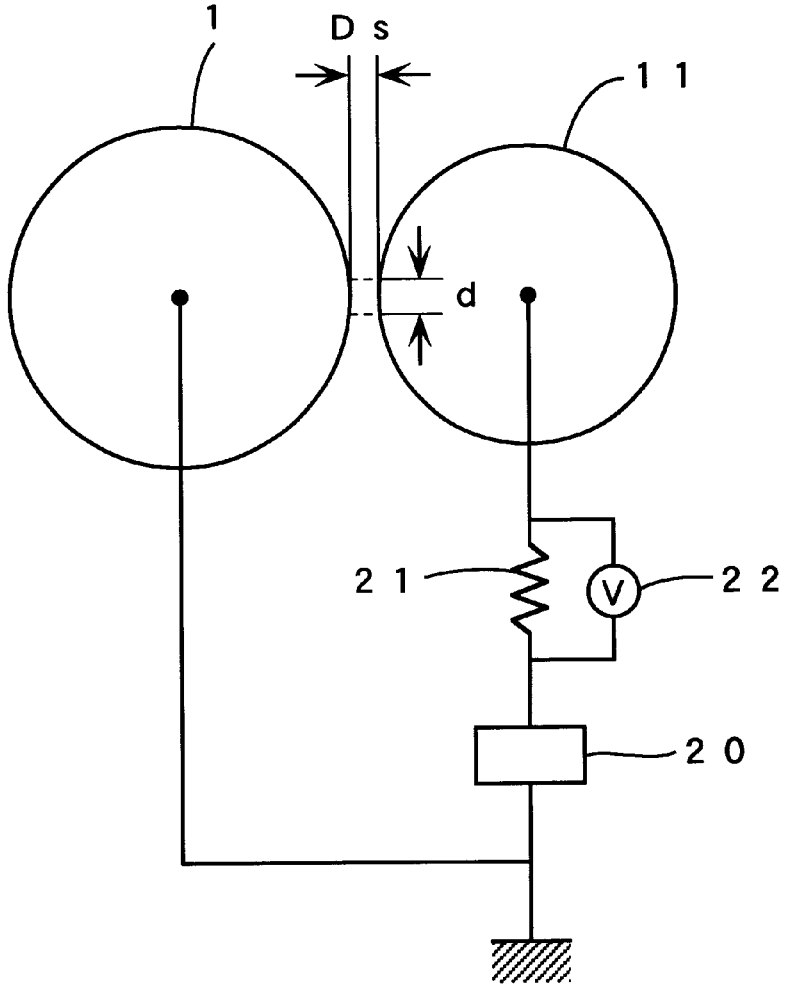
FIG. 3 is a schematic explanatory view showing a state where the impedance Zc per unit area of carriers is measured.

In finding the impedance Zc (Ω/cm$^2$) of each of the six types of carriers C1 to C6, a distance Ds between the developer carrying member 11 and the image carrying member 1 was set to 0.3 mm, and a resistor 21 was provided between the developer carrying member 11 and an AC power supply 20, as shown in FIG. 3. An AC voltage Vac having a peak-to-peak value Vpp of 1.2 kV and having a frequency of 3 kHz was applied by a rectangular wave having a duty ratio of 50% from the AC power supply 20, to measure a potential difference at both ends of the resistor 21 by a voltmeter 22 as well as to measure an effective value i of a current flowing through the resistor 21. The amount of the carriers conveyed to the developing area opposite to the image carrying member 1 by the developer carrying member 11 was set to 8.2 mg/cm$^2$ in the coat carriers C1 to C4 and C6, while being set to 4.9 mg/cm$^2$ in the binder-type carriers C5. An effective value ii of the current flowing through the resistor 21 in a case where no carriers were interposed between the developer carrying member 11 and the image carrying member 1 and an effective value $i_2$ of the current flowing through the resistor 21 in a case where the carriers were interposed therebetween were measured, to find a difference Δi (=$|i_1-i_2|$) between the effective values in the case where no carriers were interposed and in the case where the carriers were interposed. The impedance Zc of each of the six types of carriers C1 to C6 was found by the following equation (3). In the equation (3), d is the width of a developing area where development is performed, and L is the length in the axial direction of a portion where the magnetic brush was formed on the developer carrying member 11.

$$Zc=Zac\cdot d\cdot L/\Delta i \quad (3)$$

Developing devices respectively using the four types of developer carrying members S1 to S4 and the six types of carriers C1 to C6 were respectively carried in modified ones of a commercially available copying machine (CF900: manufactured by Minolta Camera Co., Ltd.). The distance Ds between the image carrier member 1 and each of the four types of developer carrying members S1 to S4 in the developing area was set to 0.3 mm, an initial surface potential Vo in the image carrying member 1 was set to −450 V, and a surface potential Vi in a portion where the electrostatic latent image was formed was set to −100 V. On the other hand, a DC bias voltage Vb1 of −350 V was applied from the DC power supply 15, and an AC bias voltage Vb2 having a peak-to-peak value Vpp of 1.2 kV and having a frequency of 3 kHz was applied by a rectangular wave having a duty ratio of 50% from the AC power supply 16. In the case of the developer 2 using the binder-type carriers C5, the amount of the developer 2 conveyed to the developing area by each of the types of developer carrying members S1 to S4 was set to 4.9 mg/cm$^2$, to set the filling factor P of the developer 2 in the developing area to 6.8%. On the other hand, in the case of the developer 2 using each of the types of coat carriers C1 to C4 and C6, the amount of the developer 2 conveyed to the developing area was set to 8.2 mg/cm$^2$, to set the filling factor P of the developer 2 in the developing area to 6.3%.

The electrostatic latent image formed on the image carrying member 1 was developed by reversal development under the following conditions, to find the amount of toners (mg/cm$^2$) adhering per unit area to a part of the electrostatic latent image. The results were shown in the following Table 1 to Table 4. In order to obtain an image having a sufficient image density, it is preferable that the amount of the adhering toners is not less than 0.6 g/cm$^2$.

A difference ΔV(=|Vo−Vb1|) between the initial surface potential Vo of the image carrying member 1 and the DC bias voltage Vb1 applied from the DC power supply 15 was changed, to find ΔV in a case where the carriers in the developer 2 adhered to the image carrying member 1. The results were also shown in the following Table 1 to Table 4. It is preferable that the value of ΔV is not less than V in terms of preventing the carriers from adhering to image carrying member 1.

TABLE 1

| type of developer carrying member and Zs (Ω/cm$^2$) | | type of carriers and Zc (Ω/cm$^2$) | | Zs · Zc | amount of adhering toners (mg/cm$^2$) | ΔV(V) |
|---|---|---|---|---|---|---|
| S1 | $3.34\times10^3$ | C1 | $6.2\times10^5$ | $2.1\times10^9$ | 0.61 | 190 |
| S1 | $3.34\times10^3$ | C2 | $1.0\times10^7$ | $3.3\times10^{10}$ | 0.55 | 221 |
| S1 | $3.34\times10^3$ | C3 | $6.3\times10^7$ | $2.1\times10^{11}$ | 0.50 | 247 |
| S1 | $3.34\times10^3$ | C4 | $9.4\times10^7$ | $3.1\times10^{11}$ | 0.48 | 256 |
| S1 | $3.34\times10^3$ | C5 | $1.5\times10^8$ | $5.0\times10^{11}$ | 0.44 | 272 |
| S1 | $3.34\times10^3$ | C6 | $2.4\times10^8$ | $7.9\times10^{11}$ | 0.40 | 280 |

TABLE 2

| type of developer carrying member and Zs (Ω/cm$^2$) | | type of carriers and Zc (Ω/cm$^2$) | | Zs · Zc | amount of adhering toners (mg/cm$^2$) | ΔV(V) |
|---|---|---|---|---|---|---|
| S2 | $6.94\times10^2$ | C1 | $6.2\times10^5$ | $4.3\times10^8$ | 0.62 | 176 |
| S2 | $6.94\times10^2$ | C2 | $1.0\times10^7$ | $6.9\times10^9$ | 0.58 | 183 |
| S2 | $6.94\times10^2$ | C3 | $6.3\times10^7$ | $4.4\times10^{10}$ | 0.55 | 215 |
| S2 | $6.94\times10^2$ | C4 | $9.4\times10^7$ | $6.5\times10^{10}$ | 0.53 | 229 |

TABLE 2-continued

| type of developer carrying member and Zs (Ω/cm²) | | type of carriers and Zc (Ω/cm²) | | Zs · Zc | amount of adhering toners (mg/cm²) | ΔV(V) |
|---|---|---|---|---|---|---|
| S2 | $6.94 \times 10^2$ | C5 | $1.5 \times 10^8$ | $1.0 \times 10^{11}$ | 0.49 | 243 |
| S2 | $6.94 \times 10^2$ | C6 | $2.4 \times 10^8$ | $1.6 \times 10^{11}$ | 0.46 | 276 |

TABLE 3

| type of developer carrying member and Zs (Ω/cm²) | | type of carriers and Zc (Ω/cm²) | | Zs · Zc | amount of adhering toners (mg/cm²) | ΔV(V) |
|---|---|---|---|---|---|---|
| S3 | 17.4 | C1 | $6.2 \times 10^5$ | $1.1 \times 10^7$ | 0.75 | 145 |
| S3 | 17.4 | C2 | $1.0 \times 10^7$ | $1.7 \times 10^8$ | 0.68 | 160 |
| S3 | 17.4 | C3 | $6.3 \times 10^7$ | $1.1 \times 10^9$ | 0.62 | 180 |
| S3 | 17.4 | C4 | $9.4 \times 10^7$ | $1.6 \times 10^9$ | 0.60 | 196 |
| S3 | 17.4 | C5 | $1.5 \times 10^8$ | $2.6 \times 10^9$ | 0.59 | 205 |
| S3 | 17.4 | C6 | $2.4 \times 10^8$ | $4.1 \times 10^9$ | 0.55 | 209 |

TABLE 4

| type of developer carrying member and Zs (Ω/cm²) | | type of carriers and Zc (Ω/cm²) | | Zs · Zc | amount of adhering toners (mg/cm²) | ΔV(V) |
|---|---|---|---|---|---|---|
| S4 | $8.01 \times 10^{-3}$ | C1 | $6.2 \times 10^5$ | $5.0 \times 10^3$ | 1.05 | 84 |
| S4 | $8.01 \times 10^{-3}$ | C2 | $1.0 \times 10^7$ | $8.0 \times 10^4$ | 0.94 | 90 |
| S4 | $8.01 \times 10^{-3}$ | C3 | $6.3 \times 10^7$ | $5.1 \times 10^5$ | 0.88 | 105 |
| S4 | $8.01 \times 10^{-3}$ | C4 | $9.4 \times 10^7$ | $7.5 \times 10^5$ | 0.83 | 111 |
| S4 | $8.01 \times 10^{-3}$ | C5 | $1.5 \times 10^8$ | $1.2 \times 10^6$ | 0.82 | 124 |
| S4 | $8.01 \times 10^{-3}$ | C6 | $2.4 \times 10^8$ | $1.9 \times 10^6$ | 0.80 | 133 |

As apparent from the results, in the developing device according to the embodiment of the present invention in which the impedance Zs (Ω/cm²) per unit area of the surface of the developer carrying member and the impedance Zc (Ω/cm²) of the carriers satisfy the condition of $1.8\times10^5 \leqq Zs\cdot Zc \leqq 2.1\times10^9$, the amount of the toners adhering to the part of the electrostatic latent image formed on the image carrying member was not less than 0.6 g/cm², and the value of ΔV at which the carriers adhered was not less than 100 V. Therefore, an image having a sufficient image density was obtained, and the carriers did not easily adhere.

Contrary to this, in a developing device in which the value of Zs·Zc was larger than the above-mentioned condition, the amount of the adhering toners was less than 0.6 g/cm². Accordingly, an image having a sufficient image density was not obtained. On the other hand, in a developing device in which the value of Zs·Zc was smaller than the above-mentioned condition, the value of ΔV at which the carriers adhered was less than 100 V. Accordingly, the carriers easily adhered.

The developer carrying member S1 in which the impedance Zs per unit area of the surface was $3.34\times10^3$ Ω/cm² and the coat carriers C1 were used, and the amount of the developer 2 conveyed to the developing area by the developer carrying member S1 was changed, to change the filling factor P of the developer 2 in the developing area in the range of 6.3 to 10%, and find the value of ΔV at which the carriers adhered, as shown in the following Table 5. The results were shown in the same Tables. In this experiment, the amount of the developer 2 in the developing area was changed. Therefore, the impedance Zc (Ω/cm²) of the coat carriers C1 was changed as shown in the same Table 5.

TABLE 5

| type of developer carrying member and Zs (Ω/cm²) | | type of carriers and Zc (Ω/cm²) | | Zs · Zc | amount of adhering toners (mg/cm²) | ΔV(V) |
|---|---|---|---|---|---|---|
| S1 | $3.34 \times 10^3$ | C1 | $6.2 \times 10^5$ | $2.1 \times 10^9$ | 6.3 | 190 |
| S1 | $3.34 \times 10^3$ | C1 | $5.2 \times 10^5$ | $1.7 \times 10^9$ | 7.9 | 110 |
| S1 | $3.34 \times 10^3$ | C1 | $4.4 \times 10^5$ | $1.5 \times 10^9$ | 8.8 | 60 |
| S1 | $3.34 \times 10^3$ | C1 | $3.7 \times 10^5$ | $1.2 \times 10^9$ | 10 | 40 |

As a result, even in a case where the impedance Zs (Ω/cm²) per unit area of the surface of the developer carrying member and the impedance Zc (Ω/cm²) of the carriers satisfy the condition of $1.8\times10^5 \leqq Zs\cdot Zc \leqq 2.1\times10^9$, when the filling factor P of the developer in the developing area was not less than 8.8%, the value of ΔV at which the carriers adhered was not more than 100 V. Accordingly, the carriers easily adhered. Therefore, it was preferable that the filling factor P of the developer in the developing area was not more than 8%.

The developer carrying member S4 in which the impedance Zs per unit area of the surface was $8.01\times10^{-3}$Ω/cm² and the coat carriers C3 were used, and the amount of the developer 2 conveyed to the developing area by the developer carrying member S4 was changed, to change the filling factor P of the developer 2 in the developing area in the range of 1.2 to 6.3%, and find the amount of the toners (mg/cm²) adhering per unit area to the part of the electrostatic latent image formed on the image carrying member 1, as shown in the following Table 6. The results were shown in the same Table 6. Also in this experiment, the amount of the developer 2 in the developing area was changed. Therefore, the impedance Zc (Ω/cm²) of the coat carriers C3 was changed as shown in the same Table 6.

TABLE 6

| type of developer carrying member and Zs (Ω/cm²) | | type of carriers and Zc (Ω/cm²) | | Zs · Zc | P(%) | amount of adhering toners (mg/cm²) |
|---|---|---|---|---|---|---|
| S4 | $8.01 \times 10^{-3}$ | C3 | $2.4 \times 10^8$ | $1.9 \times 10^6$ | 1.2 | 0.45 |
| S4 | $8.01 \times 10^{-3}$ | C3 | $1.8 \times 10^8$ | $1.4 \times 10^6$ | 2.0 | 0.60 |
| S4 | $8.01 \times 10^{-3}$ | c3 | $1.3 \times 10^8$ | $1.0 \times 10^6$ | 2.5 | 0.64 |
| S4 | $8.01 \times 10^{-3}$ | C3 | $6.3 \times 10^7$ | $5.1 \times 10^5$ | 6.3 | 0.88 |

As a result, even in a case where the impedance Zs (Ω/cm²) per unit area of the surface of the developer carrying member and the impedance Zc (Ω/cm²) of the carriers satisfy the condition of $1.8\times10^5 \leqq Zs\cdot Zc \leqq 2.1\times10^9$, when the filling factor P of the developer in the developing area was 1.2%, the amount of the toners adhering to the part of the electrostatic latent image on the image carrying member 1 was 0.45 mg/cm². Accordingly, an image having a sufficient image density was not obtained. Therefore, it was preferable that the filling factor P of the developer in the developing area was not less than 2%.

Although the present invention has been fully described by way of examples, it is to be noted that various changes and modification will be apparent to those skilled in the art.

Therefore, unless otherwise such changes and modifications depart from the scope of the present invention, they should be construed as being included therein.

What is claimed is:

1. A developing device for developing an electrostatic latent image formed on an image carrying member by toners, comprising:

a developer carrying member arranged opposite to the image carrying member for holding a developer containing toners and carriers; and a power supply member for exerting an electric field between the image carrying member and the developer carrying member, wherein letting Zs ($\Omega/cm^2$) be an impedance per unit area of the surface of said developer carrying member, and letting Zc ($\Omega/cm^2$) be an impedance of said carriers, a relationship of $1.8\times10^5 \leqq Zs\cdot Zc \leqq 2.1\times10^9$ is satisfied.

2. The developing device according to claim 1, wherein a filling factor of the developer in the developing area where said developer carrying member and the image carrying member are opposite to each other is 2 to 8%.

3. The developing device according to claim 1, wherein said power supply member applies a DC voltage and an AC voltage to the developer carrying member.

4. The developing device according to claim 1, wherein an amount of the toners adhering per unit area to a part of the electrostatic latent image on said image carrying member is not less than 0.6 $g/cm^2$.

5. The developing device according to claim 1, wherein said developer carrying member and said image carrying member are arranged a predetermined distance away from each other.

6. The developing device according to claim 1, wherein said carriers are coat carriers each having a core particle coated with resin.

7. The developing device according to claim 1, wherein said carriers are binder-type carriers each having magnetic powder dispersed in resin.

8. The developing device according to claim 1, wherein said developer carrying member has a magnet member provided in its inner part.

9. The developing device according to claim 8, wherein said developer carrying member has a resin coat layer on its surface.

10. The developing device according to claim 1, wherein $Zs\cdot Zc$ is greater than or equal to $5.1\times10^5$.

11. A method of developing an electrostatic latent image formed on an image carrying member by toners, comprising the steps of:

supplying a developer containing toners and carriers onto a developer carrying member arranged opposite to the image carrying member;

conveying a developer held on said developer carrying member to a developing area opposite to the image carrying member; and developing the electrostatic latent image by the toners in the developer under the exertion of an electric field, wherein letting Zs ($\Omega/cm^2$) be an impedance per unit area of the surface of said developer carrying member, and letting Zc ($\Omega/cm^2$) be an impedance of said carriers, a relationship of $1.8\times10^5 Zs\cdot Zc \leqq 2.1\times10^9$ is satisfied.

12. The method according to claim 11, wherein a filling factor of the developer in said developing area is 2 to 8%.

13. The method according to claim 11, wherein an amount of the toners adhering per unit area to a part of the electrostatic latent image on said image carrying member is not less than 0.6 $g/cm^2$.

14. The method according to claim 11, wherein said developer carrying member and said image carrying member are arranged a predetermined distance away from each other.

15. The method according to claim 11, wherein said carriers are coat carriers each having a core particle coated with resin.

16. The method according to claim 11, wherein said carriers are binder-type carriers each having magnetic powder dispersed in resin.

17. The method according to claim 11, wherein said developer carrying member has a magnet member provided in its inner part.

18. The method according to claim 17, wherein said developer carrying member has a resin coat layer on its surface.

19. The method according to claim 11, wherein $Zs\cdot Zc$ is greater than or equal to $5.1\times10^5$.

* * * * *